US005217504A

United States Patent [19]

Johansson

[11] Patent Number: 5,217,504

[45] Date of Patent: Jun. 8, 1993

[54] METHOD FOR CONTROLLING THE CURRENT PULSE SUPPLY TO AN ELECTROSTATIC PRECIPITATOR

[75] Inventor: Evald Johansson, Växjö, Sweden

[73] Assignee: ABB Flakt Aktiebolag, Nacka, Sweden

[21] Appl. No.: 741,449

[22] PCT Filed: Mar. 20, 1990

[86] PCT No.: PCT/SE90/00174

§ 371 Date: Aug. 13, 1991

§ 102(e) Date: Aug. 13, 1991

[87] PCT Pub. No.: WO90/11132

PCT Pub. Date: Oct. 4, 1990

[30] Foreign Application Priority Data

Mar. 28, 1989 [SE] Sweden ..... 8901063

[51] Int. Cl.[5] ..... B03C 3/68

[52] U.S. Cl. ..... 55/2; 55/105; 55/139; 323/903

[58] Field of Search ..... 55/105, 109, 139, 157, 55/2, 4; 323/903

[56] References Cited

U.S. PATENT DOCUMENTS

| | | | |
|---|---|---|---|
| 2,881,855 | 4/1959 | Klemperer | 323/903 X |
| 2,961,577 | 11/1960 | Thomas et al. | 55/105 |
| 3,059,394 | 10/1962 | Thomas et al. | 55/105 |
| 3,147,094 | 9/1964 | Hall et al. | 55/105 |
| 3,363,402 | 1/1968 | Taylor | 55/105 |
| 3,602,805 | 8/1971 | Vukasovic | 55/105 X |
| 3,641,740 | 2/1972 | Schumann et al. | 55/105 |
| 3,984,215 | 10/1976 | Zucker | 55/105 X |
| 4,413,225 | 11/1983 | Donig et al. | 55/105 X |
| 4,522,635 | 6/1985 | Matts | 55/105 X |
| 4,626,260 | 12/1986 | Jorgensen | 55/2 |
| 4,704,672 | 11/1987 | Gustafsson | 55/139 X |
| 4,808,200 | 2/1989 | Dallhammer et al. | 55/139 X |

*Primary Examiner*—Richard L. Chiesa

[57] ABSTRACT

In a method for controlling the current pulse supply to the discharge electrodes of an electrostatic precipitator unit in order to achieve maximum separation of dust from gases conducted between the discharge electrodes and the collecting electrodes of the unit at issue, current pulses (I) with a given pulse current are supplied to the discharge electrodes. The pulse frequency is varied, and instantaneous values ($U_p$, U(I=O), U(I=O+1.6)) corresponding to one another, for the voltage (U) between the discharge electrodes and the collecting electrodes are measured for a number of pulse frequencies. Then, the current pulse supply to the discharge electrodes is set to the pulse frequency at which the highest instantaneous value has been measured.

6 Claims, 1 Drawing Sheet

I,U

I
U
Up
U(I=0)
TIME
10ms
1,6ms
U(I=0+1,6)

I,U

I
U
TIME

I,U

I
U
TIME

METHOD FOR CONTROLLING THE CURRENT PULSE SUPPLY TO AN ELECTROSTATIC PRECIPITATOR

The present invention relates to a method for controlling, in an electrostatic precipitator unit with discharge electrodes and collecting electrodes between which dustladen gases are conducted for dust separation, the current pulse supplied to the discharge electrodes, in order to achieve maximum dust separation.

Usually, electrostatic precipitators are made up of a number of precipitator units arranged one after another, through which dustladen gases are successively conducted in order to be cleaned. Each of these electrostatic precipitator units has an inner chamber which is divided into a number of parallel gas passages by means of a number of vertical curtains of earthed steel plates arranged side by side to form the collecting electrodes of each unit. A number of vertical wires to which a negative voltage is connected are arranged in each gas passage to form the discharge electrodes of each unit. Due to corona discharges from the discharge electrodes, the gases are ionized in the electric field in the gas passages. The negative ions are attracted by the steel plates and, when moving towards these, collide with the dust particles in the gases, such that the particles are charged, whereupon they are separated from the gases when they are attracted by the nearest steel plate (collecting electrode), where they settle and form a growing layer of dust.

Generally, dust separation becomes more efficient as the voltage between the electrodes increases. The voltage should, however, not be too high, since that may cause flash-overs between the electrodes. Too high a current per unit area towards the collecting electrode may entail that the dust layer is charged faster than it is discharged towards said collecting electrode. Then, this charging of the dust layer entails sparking in the layer itself, so-called back-corona, and dust is thrown back into the gas. The risk of back-corona becomes greater as the resistivity of the dust increases.

To reduce the risk of back-corona, especially in separation of dust of high resistivity, and at the same time maintain such a current supply to the discharge electrodes that corona discharges occur therein, the discharge electrodes are now usually supplied with current pulses. Each precipitator unit has a separate, controllable current and/or voltage supplying circuit associated with control equipment, such that the current and/or voltage supplied to each unit can be separately controlled. Thus, the current supplied to the discharge electrodes of each unit is separately adjusted in such a manner that maximum dust separation is obtained. Today, such an adjustment is carried out entirely by hand in that the current pulse supply is adjusted and the alteration caused thereby of the degree of dust separation is controlled by measuring the opacity of the gases from the electrostatic precipitator. This adjustment is repeated until a lowest opacity value has been obtained. This method is, however, time-consuming and furthermore requires that the operator be specially trained and have great experience in electrostatic precipitators, since a considerable degree of "feeling" is needed to be able to decide which other parameters may possibly have influenced the opacity measuring during the setting operation. Furthermore, considerable adjustments have to be made for an efficient use of the opacity measurings.

SUMMARY AND OBJECTS OF THE PRESENT INVENTION

Therefore, the object of the present invention is to provide a simple current supply control method having none of the above disadvantages.

This object is achieved by a method where current pulses with a given pulse current are supplied to the discharge electrodes, that the pulse frequency is varied, that instantaneous values corresponding to one another, for the voltage between the discharge electrodes and the collecting electrodes are measured for a number of different pulse frequencies, and that the current pulse supply to the discharge electrodes is then set to the pulse frequency at which the greatest instantaneous value has been measured.

In a preferred embodiment, the peak value of the voltage is measured for every pulse frequency.

In another preferred embodiment, the instantaneous value of the voltage at the end of the current pulse is measured for every pulse frequency.

In yet another preferred embodiment, the instantaneous value of the voltage at a predetermined moment after the current pulse has ended, but before the following current pulse has started is measured for every pulse frequency. In this connection, the instantaneous value of the voltage, for example, 1.6 ms after the current pulse has ended is measured for every pulse frequency.

Preferably, the discharge electrodes are supplied with current pulses for which the pulse current is set to a maximum value considering the capacity of the current supply circuit of the unit and/or considering any flashovers between the discharge electrodes and the collecting electrodes.

The invention will be described in more detail below, reference being had to the accompanying drawing, in which

DETAILED DESCRIPTION OF THE PREFERRED EMBODIMENTS

Figure 1:
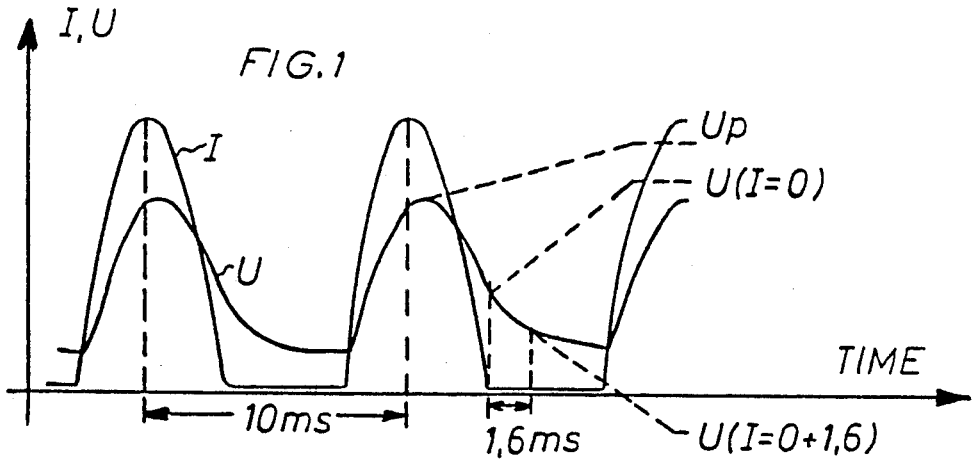
FIG. 1 illustrates the relationship between secondary current and secondary voltage, and the definition of certain parameters.

FIG. 1 illustrates the relationship between the secondary current I and the secondary voltage U; i.e., the current and the voltage which occur at the secondary side of a transformer full-wave rectifier device. The is connected to a alternating voltage which is applied to the electrostatic precipitator unit. The current level is adjusted by thyristors at the primary side of the device. The thyristors as shown in FIG. 1, when the distance between the current peaks is 10 ms, are ignited for every half cycle (CR = 1) of the AC voltage. For instance, the thyristors may also be ignited for every third, every fifth, every seventh, etc. half cycle, which is designated CR=3, CR=5, CR=7 etc., where CR means "charging ratio". Thus, an increasing CR entails a decreasing pulse frequency. It should be pointed out that the relationship between secondary current and secondary voltage depends on the degree of back-corona.

FIG. 1 also defines certain parameters used in the following description. Thus, $U_p$ designates the peak value of the secondary voltage. U(I=O) designates the secondary voltage at the end of the current pulse, and U=(I=O+1.6) designates the secondary voltage 1.6 ms after the current pulse has ended, i.e. at a moment when the secondary current still is zero.

Figure 2:
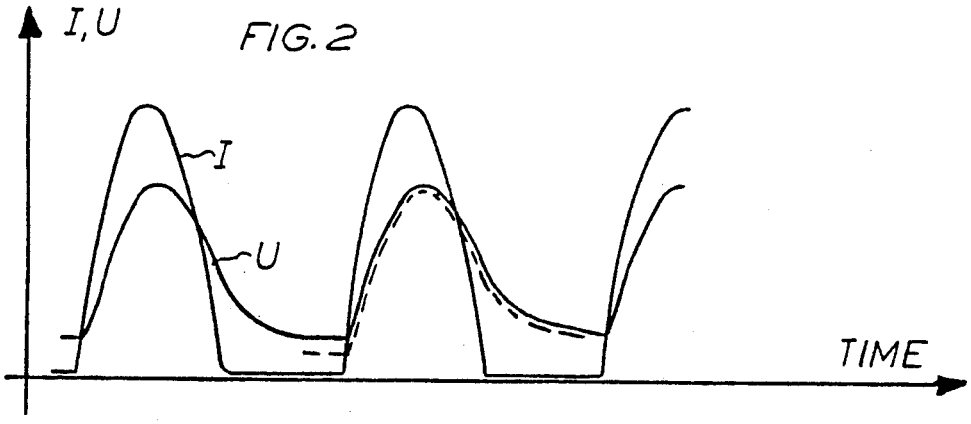
FIG. 2 corresponds to FIG. 1 and illustrates the relationship between secondary current and secondary voltage when dust of low resistivity is separated, the relationship being also illustrated at lower pulse frequency.

FIG. 2 corresponds to FIG. 1 and illustrates the relationship between the secondary current I and the secondary voltage U when dust of low resistivity is separated. In addition to what is shown in FIG. 1, FIG. 2 illustrates, by means of a dashed line, the secondary voltage obtained at lower pulse frequency (CR>1), and it is apparent that the secondary voltage is lower over the whole cycle when the pulse frequency is lower.

Figure 3:
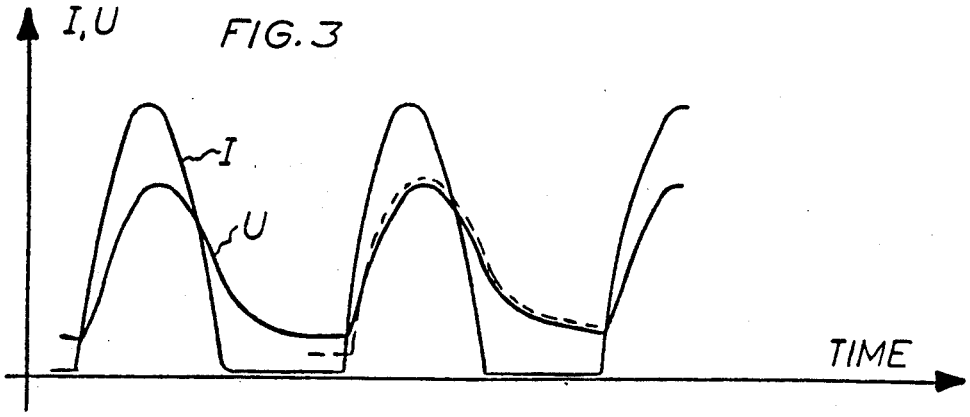
FIG. 3 corresponds to FIG. 1 and illustrates the relationship between secondary current and secondary voltage when dust of high resistivity is separated, the relationship being also illustrated at lower pulse frequency.

FIG. 3 corresponds to FIG. 1 and illustrates the relationship between the secondary current I and the secondary voltage U when dust of sufficient resistivity to produce back-corona is separated. In addition to what is shown in FIG. 1, FIG. 3 illustrates, by means of a dashed line, the secondary voltage obtained at lower pulse frequency (CR>1), and it is apparent that the secondary voltage at lower pulse frequency becomes lower at the beginning of the current pulse, but rapidly increases to transcend the continuous voltage curve after a certain time.

A test was made with an electrostatic precipitator having two successive units for cleaning of flue gases from a black liquor recovery boiler, in which MgO of very high resistivity was separated from the flue gases. The pulse current and the pulse frequency for the first unit were kept constant at values resulting in an efficient separation of MgO. The pulse frequency for the second unit was varied for a number of different pulse current values, and the opacity of the flue gases from the unit was measured for different CR values. The CR value at which the opacity was at its lowest; i.e., at which the separation was at it highest; was noted. At the pulse current values, $U_p$, U(I=0) and U(I=0+1.6) for different CR values were also measured, and the CR value for which the voltage $U_p$, U(I=0) and U(I=0+1.6), respectively, was highest, was noted. When these noted CR values were compared, the CR value at which U(I=0+1.6) was highest, was found to agree with the CR value at which the opacity was at its lowest.

Another test was made with an electrostatic precipitator for cleaning of flue gases from a coal-fired power station, in which ash of low resistivity was separated from the flue gases. In this case, the CR value at which $U_p$ was highest, was found to be closest to the CR value at which the opacity was at its lowest. However, the CR values at which U(I=0) and U(I=0+1.6) were highest, also agreed with the CR value at which the opacity was at its lowest.

Furthermore, another test was also made with an electrostatic precipitator for cleaning of flue gases from a coal-fired power station, in which ash with high resistivity was separated from the flue gases. In this case, the CR values at which all voltages $U_p$, U(I=0) and U(I=0+1.6) were highest, agreed with the CR value for which the opacity was at its lowest.

Thus, there is a relationship between the secondary voltage and the separation capacity. For a given pulse current, obtained for instance with a predetermined ignition angle for the thyristors at the primary side of the transformer full-wave recitifer device, it was found that the CR values at which $U_p$, U(I=0) and U(I=0+1.6) are highest, gave a pulse frequency setting very close to the setting resulting in maximum separation. A CR value at which $U_p$ is highest, is preferable when dust of low resistivity is separated, and a CR value at which U(I=0+1.6) is highest, is preferable when dust of high resistivity is separated. Of the chosen parameters $U_p$, U(I=0) and U(I=0+1.6), none seems to be more suitable than the others under all types of separation conditions. It is also conceivable to use as a parameter some kind of average value for the secondary voltage, the value being centered upon the end point of the current pulse or any other suitable point. It should be observed that the parameter U(I=0+1.6) is rather abitrarily chosen, and that the secondary voltage at any other suitable moment between two successive current pulses also can be used as a parameter.

On the basis of the teachings related above, the adjustment of the current supply to the discharge electrodes of an electrostatic precipitator unit is thus suitably carried out in accordance with the invention as follows. The discharge electrodes of the electrostatic precipitator unit is supplied with current pulses for which the pulse current is set to a maximum value considering the capacity of the current supply device of the unit and/or considering any flash-overs between the discharge electrodes and the collecting electrodes. For the other units possibly forming part of the same electrostatic precipitator, the pulse current and pulse frequency are, during this operation, maintained at constant values appearing to result in efficient dust separation. The pulse frequency of the current pulses to the discharge electrodes of the studied unit is varied, and the instantaneous value of a secondary voltage parameter, suitably one of the above-mentioned parameters $U_p$, U(I=0) and U(I=0+1.6), is measured for a number of different pulse frequencies. The current pulse supply to the discharge electrodes of the studied unit is then set to the pulse frequency at which the instantaneous value of the checked parameter is at its highest. As mentioned above, this pulse frequency is very close to the pulse frequency resulting in maximum separation.

As is seen, this setting method, in which separate setting for the units in an electrostatic precipitator is possible, is easily carried out and requires no specialist competence of the operator. Furthermore, the method gives a rapid response since only electrical signals are used and no measuring of the opacity is needed. The influence caused by even small changes of the pulse frequency on the separation capacity of the unit can be controlled by supervision of the chosen secondary voltage parameter. Also, the method should make possible the development of efficient algorithms for rectifier control.

I claim:

1. A method for controlling, in an electrostatic precipitator unit having discharge electrodes and collecting electrodes, a current pulse supplied to the discharge electrodes, comprising the steps of:

(a) supplying current pulses of a non-varying predetermined magnitude to the discharge electrodes;

(b) varying a frequency of the current pulse supplied in said step (a);

(c) measuring an instantaneous voltage value corresponding to a voltage between the discharge electrodes and the collecting electrodes for each different frequency created by said step (b); and (d) supplying current pulses to the discharge electrodes at the frequency having a maximum instantaneous voltage value measured in said step (c).

2. The method as claimed in claim 1, wherein the instantaneous voltage value measured for every frequency is a peak value of the voltage.

3. The method as claimed in claim 1, wherein the instantaneous voltage value measured for every frequency is a voltage at an end of a current pulse.

4. The method as claimed in claim 1, wherein the instantaneous voltage value measured for every frequency is a voltage at an instant of time between an end of one current pulse and a start of a next current pulse.

5. The method as claimed in claim 4, wherein the instantaneous voltage value measured for every frequency is a voltage occurring 1.6 ms after the end of a current pulse.

6. The method as claimed in any one of claims 1–5, wherein the discharge electrodes are supplied with current pulses which are set at a value not exceeding a capacity of a current supply unit of the precipitator and wherein the value also prevents flash-overs between the discharge electrodes and the collecting electrodes.

* * * * *